US006082637A

United States Patent [19]

Ludwig

[11] Patent Number: 6,082,637

[45] Date of Patent: Jul. 4, 2000

[54] NOZZLE DEVICE

[75] Inventor: Ralf Ludwig, Bielefeld, Germany

[73] Assignee: INT Gesellschaft mit beschränkter Haftung Ingenierbüro für Neue Technologien, Anlagenbau Verfahrenstechnik, ADFOSY, Bielefeld, Germany

[21] Appl. No.: 09/161,736

[22] Filed: Sep. 29, 1998

[51] Int. Cl.[7] ..... B05B 1/28

[52] U.S. Cl. ..... 239/290; 239/292; 239/296; 239/299; 239/423; 138/112; 138/113

[58] Field of Search ..... 239/290, 292, 239/296, 299, 418, 423, 424, 553, 553.3, 553.5, 590, 590.3, 590.5; 138/112, 113; 141/105; 222/568

[56] References Cited

U.S. PATENT DOCUMENTS

| | | | |
|---|---|---|---|
| 1,492,593 | 6/1924 | Day | 239/418 |
| 1,989,696 | 2/1935 | Kelley . | |
| 3,343,250 | 9/1967 | Berto et al. | 138/113 |
| 4,786,088 | 11/1988 | Ziu | 138/113 |
| 4,995,333 | 2/1991 | Keller et al. . | |
| 5,421,490 | 6/1995 | Lichte . | |

FOREIGN PATENT DOCUMENTS

| | | |
|---|---|---|
| 4120881 C1 | 6/1991 | Germany . |
| 195 00 053 | 3/1996 | Germany . |

*Primary Examiner*—Henry J. Recla
*Assistant Examiner*—Khoa Huynh
*Attorney, Agent, or Firm*—Venable; Gabor J. Kelemen

[57] ABSTRACT

A nozzle device includes an axially extending tubular, cylindrical outside part; and a cap threaded on the outside part at the front or discharge end of the device and having a discharge bore composed of a rearward cylindrical portion having a first diameter; a frontal cylindrical portion having a second diameter less than the first diameter; and a frusto-conical portion connecting the rearward and frontal cylindrical portions with one another. An axially extending inside part is coaxially received in the outside part and has an outer wall defining, with the inner wall of the outside part, an annular space for guiding gas therethrough. The annular space is axially adjoined by the discharge bore of the cap. The inside part further has a forwardly conically tapering end portion projecting into the frontal cylindrical portion of the discharge bore of the cap; an axial bore for guiding a viscous material therethrough; and a nozzle bore axially adjoining the axial bore and having an outlet opening for discharging the viscous material. The nozzle bore outlet opening is situated within the frontal cylindrical portion of the discharge bore of the cap. A port is provided in the outside part for introducing the gas into the annular space. At least three support lugs are positioned in the annular space in engagement with the inner wall of the outside part and the outer wall of the inside part for coaxially positioning the inside part relative to the outside part.

6 Claims, 1 Drawing Sheet

NOZZLE DEVICE

BACKGROUND OF THE INVENTION

The invention relates to a nozzle device for discharging viscous materials, particularly adhesive or sealing materials, onto a surface in ribbon form. The device includes a cylinder-shaped inside part having an axial bore into which the material is introduced at a first or input end of the device and discharged by an axial nozzle bore at a second or discharge end of the device. The device further has a cylinder-shaped outside part that coaxially and in a spaced manner surrounds the inside part to form an annular space. The nozzle device also has a feed port extending radially through the wall of the outside part into the annular space to supply a gas, especially air, and a cap to be screwed onto the outside part at the end of the nozzle device. Further, a coaxial discharge bore is provided, having an internal cylinder-shaped bore segment, an adjacent, conically tapering surface and an outer, cylindrical bore segment adjoining the conical surface.

U.S. Pat. No. 5,421,490 shows and describes a nozzle device of the above-noted type where axially parallel channels are formed on the outer circumference of the inside part, so that the annular space between the inside and outside parts is divided into individual channels by axially parallel separating walls. According to the patent, a particularly uniform ribbon cross-section can be achieved in this way. Such a solution is sought to provide an improvement over a previously known method, described, for example, in U.S. Pat. No. 4,995,333. According to this method, helical rather than axially parallel gas channels are provided, so that the gas jets helically impinge on the discharged material string. Under certain conditions this causes the material string to be deflected continuously in a circular motion, so that the material is deposited in the form of a ribbon, composed of a plurality of overlapping circles. To be sure, this method of string forming is criticized in the earlier noted U.S. Pat. No. 5,421,490 because necessarily more material reaches the edge regions than the center region of the developing string. Such an irregularity, however, is frequently accepted in practice, especially since a certain deformation and adaptation of the material string occurs, for example, when adhesive or sealing materials are applied, as a result of the subsequent pressing together of two parts to be connected.

It is a disadvantage of the two known solutions that the gas, especially air, must be driven through relatively narrow channels toward the nozzle opening, thereby limiting the possible amount of air. On the other hand, the possible amount of air itself determines the possible material flow quantity and thus also determines the processing speed. Since, however, an increasing material viscosity requires a higher amount of air to form the material string, the limiting of the air amount unfavorably affects the delivery speed, especially for highly viscous materials.

On the other hand, a gun for applying an asphalt-type material is known, for example, from U.S. Pat. No. 1,989,696, for example, where the annular space between the inside part and the outside part is completely unobstructed so that a large amount of gas can be supplied. In that case, however, the inner tube is not supported such that it is positioned in a precise and centered manner inside the outer tube.

SUMMARY OF THE INVENTION

It is thus an object of the invention to provide an improved nozzle device of the aforementioned type, in particular to facilitate the feeding of gas.

This object is achieved with a nozzle device of the aforementioned type in which the inside part conically narrows at the discharge end of the nozzle device and projects into the discharge bore of the cap in such a way that the nozzle bore of the inside part ends inside of the outer, cylindrical bore segment of the discharge bore, and further, at least three support lugs are positioned in the annular space in engagement with the inner wall of the outside part and the outer wall of the inside part for coaxially positioning the inside part relative to the outside part.

In accordance with the invention, the annular space between the inside part and the outside part to which the gas is supplied, is substantially unobstructed so that a high amount of gas can be supplied with relatively low pressures.

The annular space contains only a few support lugs, distributed over the circumference, which ensure that the inside part maintains its exact concentric position within the outside part. Such a support is essential, particularly in the nozzle opening region, which must be positioned with high precision inside the discharge bore of the cap if a uniform swirling of the material string is to occur.

It has been found that even with the presently available type of nozzle, the material string is deposited in continuously consecutive circles. While the gas acts upon the total circumference of the material string inside the cap discharge bore and subsequently in the region in front of the cap, an instability develops, which leads to the above-described, circular creep of the adhesive material string. The viscous mass is deposited as a uniform, reproducible string only if it is ensured that the inside part is positioned coaxially within the outside part and the nozzle opening is positioned concentrically inside the discharge bore of the cap.

The conical tip of the inside part and the conical section of the discharge bore in the cap preferably extend parallel to each other.

The support lugs between the inside part and the outside part are preferably arranged in a circular array and are distributed over the circumference at uniform angular distances. Viewing a set of lugs arranged in a common radial plane, it is sufficient if the lugs are three in number, spaced at 120° from one another, for maintaining an exact positioning of the inside part, relative to the outside part. It is also feasible to use several such lug sets; they can also have more than three support lugs each. It will be apparent that the more flexible or soft the materials selected for the inside part and the outside part and the lower the wall thicknesses, the better the support must be between inside part and outside part.

The support lugs may be formed on the outer wall face of the inside part or on the inner wall face of the outside part or on both.

Preferably, in the region of the input end, the inside part has an outer threaded segment, whose diameter is larger than the outer diameter of that segment of the inside part that extends toward the discharge end of the device from the outer thread segment. A shoulder serves as a transition between the two segments. The outside part has an enlarged axial bore situated in the zone of the input end and provided with an inner threaded segment which, in the direction of the discharge end of the device, continues as a down-stepped bore segment, while forming a shoulder. By virtue of this arrangement a defined, a mutual relative longitudinal positioning is obtained by the abutting shoulders of the inside and outside parts. Such a relative longitudinal position also determines the operating position for the nozzle opening in the discharge bore of the cap.

DESCRIPTION OF THE PREFERRED EMBODIMENT

Figure 1:
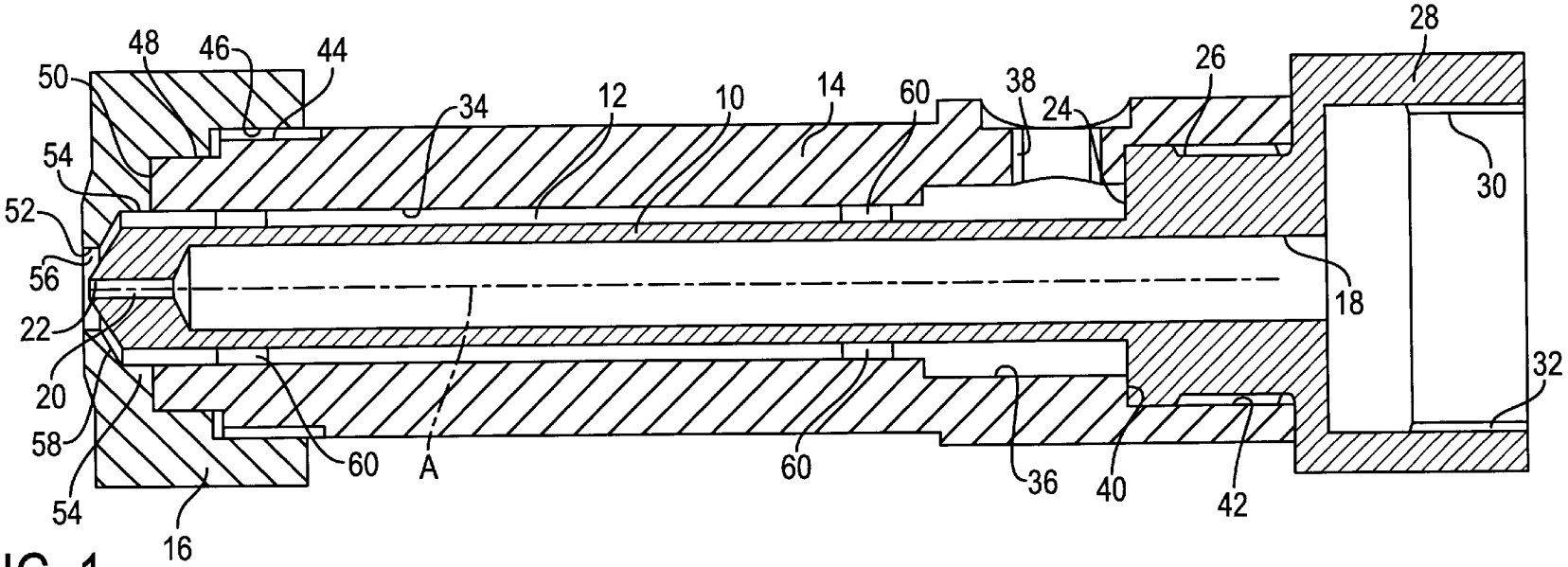
FIG. 1 is a schematic axial sectional view of a preferred embodiment of the invention.

Turning to FIG. 1, the nozzle device according to the invention is composed of a cylindrical tubular inside part 10, an outside part 14 that surrounds the inside part 10 at a distance to thus form an annular space 12, as well as a cap 16 which is screwed onto and partially covers the left end of outside part 14. The nozzle device has a central longitudinal axis A.

Since the gas and material are guided through the nozzle from the right to the left as viewed in FIG. 1, the nozzle device end positioned on the right is referred to as the first or input end and the left end is referred to as the second or discharge end. The second end thus forms the front end, whereas the first end forms the rearward end, into which the material and the gas are introduced.

The inside part 10 has an axial bore 18 which is adjoined by a nozzle bore 20 having a diameter which is considerably smaller than the diameter of the axial bore 18. The channel formed by the bores 18, 20 serves to advance the viscous material, e.g. an adhesive agent or a sealing mass. The nozzle bore 20 terminates at a nozzle opening 22.

In the direction of the first or input end of the nozzle device the inside part 10 expands via a shoulder 24 to form an outer thread segment 26 which is adjoined, again towards the input end, by an enlarged end segment 28 which may have a cylindrical or hexagonal shape. The end segment 28 has a large-diameter bore 30 which is in axial alignment with the bore 18. The wall of the bore 30 is provided with a thread 32 so that the -entire nozzle device can be screwed to a non-illustrated material supply system via a suitable adapter.

The outside part 14 has an axial bore 34 having a diameter which is greater than the external diameter of the inside part 10, whereby the earlier-noted annular space 12 is obtained. In the right-hand end region the bore 34 expands to first form a cylindrical chamber 36, into which extends a radial bore 38 for the supply of gas from the outside. The right-hand end of the chamber 36 expands by means of an annular shoulder 40 to form an inner thread segment 42 of the outside part 14. The inner thread segment 42 of the outside part 14 and the outer thread segment 26 of the inside part 10 are in a threaded engagement with one another. Thus, the inside part 10 is screwed into the outside part 14 until the shoulder 24 of the inside part 10 and the shoulder 40 of the outside part 14 are in an abutting relationship with one another. Such a relative axial position of the inside and outside parts 10 and 14 derived from the abutting relationship of the shoulders 24 and 40 must be precisely defined—and corrected by interposed washers, if required—because such position sets the axial position of the nozzle opening 22 relative to the cap 16.

The outside part 14 has, spaced from its frontal end, an external thread segment 44, while the cap has an internal thread segment 46. Thus, when the cap 16 has been screwed on the outside part 14, the cap 16 covers the frontal region of the outside part 14. From the thread segments 44, 46 the outside diameter of the outside part 14 and the inside diameter of the cap 16 are reduced toward the frontal end to form a down-stepped cap portion 48 which terminates at an inside bottom surface 50 of cap 16. From the bottom surface 50, axially within the cap 16, a discharge bore 52 extends which is composed of three axially consecutive segments. A rearward bore segment 54 and an frontal bore segment 56 are cylindrical in shape and are connected to one another by a forwardly tapering intermediate frustoconical segment 58. As may be well observed in FIG. 1, the nozzle opening 22 is positioned inside the frontal cylindrical bore segment 56.

Figure 2:
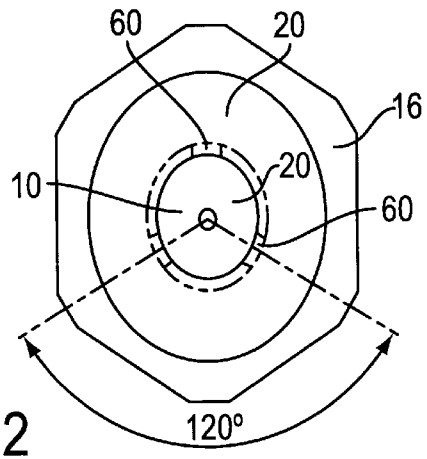
FIG. 2 is a sectional view taken along line II—II of FIG. 1.

For an exact centering of the inside part 10 within the outside part 14 and for obtaining a precisely annular space 12, support lugs 60 are provided between and in contact with the outside part 14 and the inside part 10. The support lugs 60 are formed, for example, in a circular array on the external face of the inside part 10. FIG. 2 shows three support lugs 60, arranged at angular distances of 120°. The support lugs 60 have a particular importance in the outer frontal region of the inside part 10, that is, at the left end of the structure shown in FIG. 1. It is also feasible to provide two sets of circularly arranged support lugs 60 in the front and rear regions of the annular space 12, as shown in FIG. 1. The support lugs 60 can also be formed on the inside surface of the outside part 14.

Since a considerably larger amount of the supplied gas can pass mostly without friction through the nozzle device according to the invention, than through conventional structures, more gas, particularly air, can be directed toward the outflowing material with the same feed pressure and the same pressure source capacity, thereby allowing the processing of material having a considerably higher viscosity. Also, a considerably wider material ribbon can be formed under otherwise equal conditions.

The device according to the invention is easier to clean than the known nozzle devices, where the space between inside part and outside part is divided into narrow channels, as described above.

It will be understood that the above description of the present invention is susceptible to various modifications, changes and adaptations, and the same are intended to be comprehended within the meaning and range of equivalents of the appended claims.

What is claimed is:

1. A nozzle device for simultaneously discharging a gas and a viscous material, comprising (a) a front end, a rear end and a longitudinal axis;

(b) an axially extending tubular, cylindrical outside part having (1) an inner wall;

(2) an inner thread segment at said rear end; and (3) a shoulder;

(c) a cap threaded on said outside part at said front end and having a discharge bore coaxial with said longitudinal axis; said discharge bore being composed of (1) a rearward cylindrical portion having a first diameter;

(2) a frontal cylindrical portion having a second diameter less than said first diameter; and (3) a frustoconical portion connecting said rearward and frontal cylindrical portions with one another;

(d) an axially extending inside part coaxially received in said outside part and having (1) an outer wall defining, with said inner wall of said outside part, an annular space for guiding the gas therethrough; said annular space being axially adjoined by said discharge bore of said cap;

(2) a forwardly conically tapering end portion projecting into said frontal cylindrical portion of said discharge bore of said cap;

(3) an axial bore for guiding the viscous material therethrough;

(4) a nozzle bore axially adjoining said axial bore and having an outlet opening for discharging the viscous material; said outlet opening of said nozzle bore being situated within said frontal cylindrical portion of said discharge bore of said cap; and (5) two axially consecutive first and second stepped length portions at said rear end; said shoulder of said outside part supporting said first stepped length portion of said inside part; said first stepped length portion having an outer thread segment and said second stepped length portion adjoining said first stepped length portion and constituting a terminal portion; said inner thread segment of said outside part threadedly engaging said outer thread segment of said inside part; said second stepped length portion having an outer diameter greater than an outer diameter of said first stepped length portion;

(e) a port provided in said outside part for introducing the gas into said annular space; and (f) at least three support lugs positioned in said annular space in engagement with said inner wall of said outside part and said outer wall of said inside part for coaxially positioning said inside part relative to said outside part.

2. The nozzle device as defined in claim 1, wherein said frustoconical portion of said discharge bore and said conically tapering end portion of said inside part extend parallel and spaced from one another.

3. The nozzle device as defined in claim 1, wherein said support lugs are arranged in a circular array.

4. The nozzle device as defined in claim 3, wherein said lugs are three in number and are spaced 120° from one another.

5. The nozzle device as defined in claim 1, wherein said support lugs are arranged in two axially spaced circumferential arrays.

6. The nozzle device as defined in claim 5, wherein in each array said lugs are three in number and spaced 120° from one another.

* * * * *